United States Patent [19]

Danino et al.

[11] Patent Number: 4,651,992

[45] Date of Patent: Mar. 24, 1987

[54] PUZZLE-TYPE GAME

[75] Inventors: David Danino; Shachar Ben-Meir, both of Givatayim, Israel

[73] Assignee: Cybertronics Ltd., Rishon Lezion, Israel

[21] Appl. No.: 802,171

[22] Filed: Nov. 25, 1985

[30] Foreign Application Priority Data

Nov. 30, 1984 [IL] Israel ..... 73694

[51] Int. Cl.[4] ..... A63F 9/08

[52] U.S. Cl. ..... 273/155; 40/503; 434/174; 434/206; 434/402

[58] Field of Search ..... 273/153 R, 155, 156, 273/157 R; 40/503; 434/174, 206, 402

[56] References Cited

U.S. PATENT DOCUMENTS

| | | | |
|---|---|---|---|
| D. 274,074 | 5/1984 | Brunko | 273/155 X |
| 407,374 | 7/1889 | Smith | 434/174 |
| 2,476,194 | 7/1949 | Hollowell | 40/503 X |
| 3,873,096 | 3/1975 | Shoptaugh | 273/156 |

FOREIGN PATENT DOCUMENTS

| | | | |
|---|---|---|---|
| 2501516 | 9/1982 | France | 273/153 S |
| 422704 | 1/1935 | United Kingdom | 273/155 |

*Primary Examiner*—Anton O. Oechsle

*Attorney, Agent, or Firm*—Benjamin J. Barish

[57] ABSTRACT

A puzzle-type game comprises at least five manipulatable members, for example of square or circular cross-section, each formed at one end with fingers, and at the opposite end with a circular recess, such that a plurality of the members may be assembled by the player according to any desired sequence, and to be rotated to any desired angular position with respect to each other. Each member carries on its outer faces indicia representing one element of a valid multi-element relationship produced only when the indicia of all the members are aligned according to a predetermined sequence and a predetermined angular position. In one described example, the indicia represent arithmetical equations, and in other described examples they represent the letters of the alphabet, and a maze.

8 Claims, 8 Drawing Figures

FIG. 5
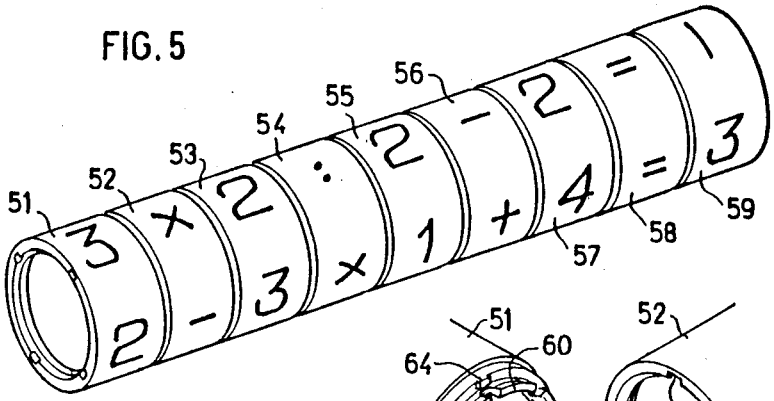
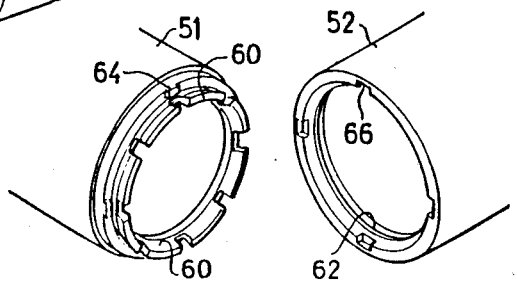
FIG. 6
FIG. 7
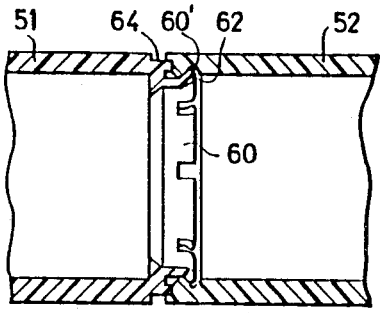
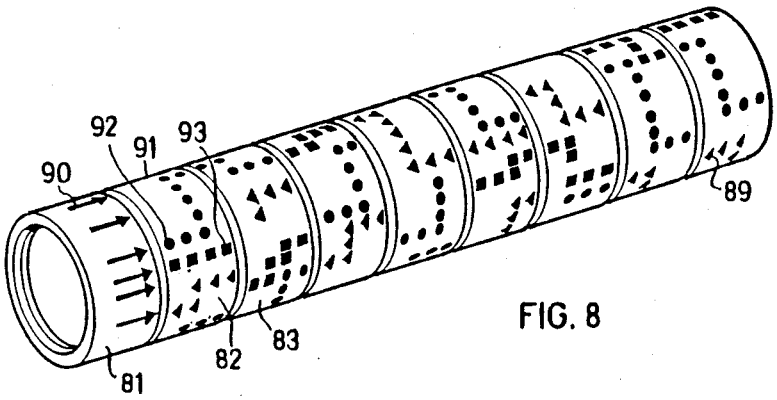
FIG. 8

PUZZLE-TYPE GAME

The present invention relates to puzzle-type games, particularly to games which include a plurality of interconnected members to be manipulated in a certain manner in order to provide a correct solution with respect to indicia carried by such members.

According to the present invention, there is provided a puzzle-type game comprising a plurality of at least five manipulatable members, each having a plurality of different regions on their outer faces. Each of the manipulatable members is formed at one end with a plurality of fingers defining a circle, and at the opposite end with a circular recess dimensioned to detachably and rotably receive the fingers of another like member, enabling a plurality of the members to be assembled by the player, according to any desired sequence, and to be rotated while so assembled to any desired angular position with respect to each other. Each of the manipulatable members carries on different regions of its outer face indicia representing one element of a valid multi-element relationship produced only when the indicia of all the manipulatable members are aligned according to a predetermined sequence and predetermined angular positions with respect to each other.

According to further important features of the invention, each of the manipulatable members is of hollow construction and is formed with a central opening circumscribed by the plurality of fingers in one end of the manipulatable member, and a circular recess on the inner face of the opposite end of the manipulatable member for detachably receiving the fingers of another like member. The two ends of each manipulatable member are formed with complementary retainer means to releasably retain attached members in their rotated angular positions. For this purpose, the plurality of fingers are configured such that when received in the circular recess in the inner face of another like manipulable member, they urge the two so-attached manipulable members axially toward each other. The complementary retainer means comprise axially-projecting projections formed in one end of each manipulatable member and complementary detents formed in the opposite end.

Several embodiments of the invention are described below for purposes of example.

In one described embodiment, each manipulatable member has "n" different regions around its outer periphery, the different regions of some of the manipulatable members carrying indicia representing the numbers 1—n, respectively, in different sequences, and the different region of others of the manipulatable members carrying indicia representing various arithmetical operations, the valid multi-element relationship being a correct solutiong to an arithmetic equation represented by the indicia on all the aligned regions of all the attached manipulatable members.

In a second described embodiment, the different regions of the outer face of one of the manipulatable members carry indicia representing a plurality of different starting points, and the different regions of the remaining manipulatable members carrying indicia in the form of different arrangements of symbols selectively alignable with the symbols of adjacent manipulatable members, the valid multi-element relationship representing at least one continuous path of like symbols starting from at least one of the starting points of the one manipulatable member.

BRIEF DESCRIPTION OF THE DRAWINGS

The invention is herein described, by way of example only, with reference to the accompanying drawings, wherein:

FIG. 5 illustrates another version wherein the manipulatable members are of circular cross-section;

FIG. 6 illustrates the construction at the two ends of each manipulatable member to enable a plurality of like members to be assembled by the players according to any desired sequence and to be rotated to any desired angular position;

FIG. 7 is a sectional view illustrating the attaching ends of two like members; and FIG. 8 is a view illustrating a further embodiment wherein the indicia define a maze.

DESCRIPTION OF PREFERRED EMBODIMENTS

Figure 1:
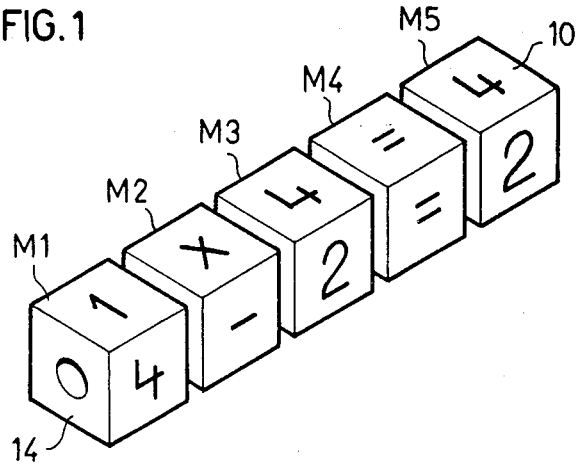
FIG. 1 illustrates a simple form of puzzle-type game constructed in accordance with the present invention.
Figure 2:
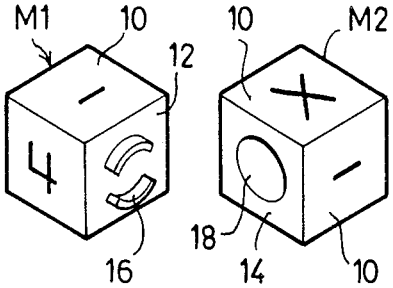
FIG. 2 more particularly illustrates the construction of each of the manipulatable members in the game of FIG. 1.

The puzzle-type game illustrated in FIG. 1 includes five manipulatable members $M_1$–$M_5$ attached to each other to form a straight line. The illustrated members $M_1$–$M_5$ are of cubical or hexahedron configuration, thereby providing four peripheral faces or regions 10 and two end faces 12 and 14 (FIG. 2). The end faces 12 and 14 are formed respectively, with a plurality of fingers defining a circle, and with a circular recess dimensioned to detachably and rotatably receive the fingers of another like member. The arrangement is such as to permit the manipulatable members to be selectively attached to each other according to any desired sequence and angular position by inserting the fingers of one into the circular recess of another.

As shown particularly in FIG. 2, end face 12 includes two curved fingers or ribs 16 lying on a circle. The circular recess 18 in the opposite end face 14 has a diameter equal to the radius of curvature of fingers 16. Thus, the two fingers 16 on one member (e.g. $M_1$) may be received within the circular recess 18 of another member (e.g. $M_2$) in order to attach these two members together, and also to permit one to be rotated with respect to the other to align any one of the four outer faces 10 of one member with respect to any one of the four peripheral faces of the other.

Each of the four peripheral faces or regions 10 of each member $M_1$–$M_5$ carries indicia representing one element of a valid multi-element relationship produced only when all the members are in a predetermined sequence and angular position with respect to each other. In the example illustrated in FIGS. 1 and 2, the valid multi-element relationship represents a correct solution to an arithmetic equation. Therefore, some of the members include indicia representing numerical characters, and others include indicia representing arithmetical operations. In the example illustrated in FIGS. 1 and 2, members $M_1$, $M_3$ and $M_5$ include the numbers "1–4", but in different sequences; and members $M_2$ and $M_4$ include arithmetical operations. In this example, member $M_2$ includes the arithmetical operations: add (+), subtract (−), multiply (×), and divide (:); whereas member $M_4$ includes an equal sign (=) on all four of its peripheral faces 10.

The five members $M_1$–$M_5$ must be assembled in the correct sequence as illustrated in FIG. 1, and must also be rotated to the correct angular position so as to align their indicia carrying faces 10 in certain positions to provide a correct solution to an arithmetical equation. In the embodiment of the invention illustrated in FIGS. 1 and 2, a correct solution of the game or puzzle require that all four faces of the members define correct arithmetical relationships.

Figure 3:
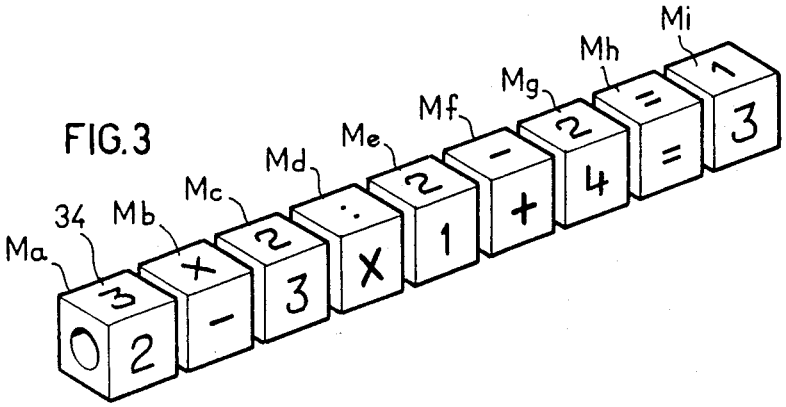
FIG. 3 illustrates a more complicated game construction in accordance with the present invention.

FIG. 3 illustrates a more complicated version wherein the game includes nine manipulatable members $M_a$–$M_i$ all of cubical shape. The indicia carried on the outer faces or regions 34 of members $M_a$–$M_i$ are also in the form of numerical characters or arithmetical operations so that when the members are properly aligned and in the proper sequence, the indicia represent the correct solution of an arithmetical solution. As in the arrangement of FIGS. 1 and 2, some of the members ($M_a$, $M_c$, $M_e$, $M_g$ and $M_i$) carry the members 1–4; whereas the remaining members carry indicia representing arithmetical operations.

FIG. 3 illustrates the members in their proper sequence and proper angular positions, wherein it will be seen that both lines of faces 34 seen in FIG. 3 represent correct solutions to arithmetic equations. Table 1 below sets forth the indicia carried on all four sides of each member and there respective positions, both sequential and angular, to which the members must be manipulated in order to produce a correct solution to the game:

TABLE 1

| | $M_a$ | $M_b$ | $M_c$ | $M_d$ | $M_e$ | $M_f$ | $M_g$ | $M_h$ | $M_i$ |
|---|---|---|---|---|---|---|---|---|---|
| (a) | 3 | × | 2 | ÷ | 2 | − | 2 | = | 1 |
| (b) | 2 | − | 3 | × | 1 | + | 4 | = | 3 |
| (c) | 1 | ÷ | 1 | + | 3 | ÷ | 3 | = | 2 |
| (d) | 4 | + | 4 | − | 4 | × | 1 | = | 4 |

One of the rules of play is that multiplication and division are performed before addition and subtraction.

It will thus be seen that, in the example illustrated in FIG. 3, a correct solution of the puzzle requires that a correct arithmetical equation be displayed on all four sides of the members.

Figure 4:
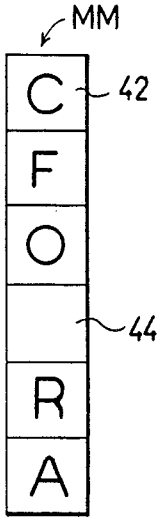
FIG. 4 illustrates a further embodiment of the invention wherein the indicia are in the form of alphabetical characters to permit the correct spelling of one or more words.

The manipulatable members could include a different number of indicia-carrying regions or faces, and could also include other forms of indicia. FIG. 4 shows the indicia layout of one manipulatable member in the form of a cube having four indicia-carrying peripheral regions or faces 42, and also having indicia in the form of alphabetical characters, rather than numbers and arithmetical operations as in FIGS. 1–3. Preferably, the game would include a larger number of such manipulatable members, for example 26 or more, and one face of at least some, or preferably all, of the manipulatable members would be blank, as shown by face 44 in FIG. 4, to signify the end of a word.

FIG. 5 illustrates a game also including 9 manipulatable members, therein designated 51–59, but each being of hollow construction and of circular cross-section. One end of each manipulatable member (represented by the illustrated end of member 51 in FIGS. 6 and 7) is formed with a plurality of fingers 60 circumscribing the opening in that end of the member, and the opposite end of each member (represented by the illustrated end of member 52 in FIGS. 6 and 7) is formed with a circular recess 62 on the inner face of the member for detachably receiving the fingers 60 of another like member.

The two ends of each manipulatable member are also formed with complementary retainer means to releasably retain the two attached members in each of their rotated angular positions. Such retainer means comprise an axially-extending projection 64 integrally formed in the end illustrated by member 51, and a complementary detent 66 formed in the opposite end illustrated by member 52. Each of the manipulatable members has four indicia-bearing regions on their outer faces and is selectively positionable to any one of four angular positions; accordingly, there are four projections 64 formed in one end of each member, and four detents 66 formed in the opposite end.

Fingers 60, and recess 62 receiving them, are both shaped such that when the projections are received in the circular recess, the two manipulatable members are urged towards each other by the inherent resiliency of the fingers. Projections 64 formed in the end of member 51 is thus urged against the end of member 52 until they snap into the detents 66 formed in the latter to releasably retain the two attached members in their selected angular positions.

For purposes of example, it will be seen that the indicia illustrated in the construction of FIG. 5 is the same as illustrated in the construction of FIG. 3.

FIG. 8 illustrates a further variation wherein the construction of the manipulatable members is the same as described above with respect to FIGS. 5–7, but the indicia carried on the different regions of the outer faces of the manipulatable members represent a maze rather than arithmetical operations.

Thus, the FIG. 8 game also includes nine manipulatable members 81–89 constructed as described in FIGS. 5–7 enabling them to be assembled according to any desired sequence and to be rotated to any desired angular position. In the arrangement of FIG. 8, however, one manipulatable member 81 is formed with a plurality of selectable starting points, represented by arrows 90, and the remaining manipulatable members 82–89 are formed with different arrangements of various symbols. In the example illustrated there are three types of symbols, namely a circle 91, a square 92 and a triangle 93. The player assembles the manipulatable members according to any desired sequence, and rotates them to any selected angular position, in an attempt to provide a correct solution represented by at least one continuous path of like elements starting from at least one of the arrows 90 in member 81 and continuing through the maze represented by the symbols in the remaining members 82–89 to the opposite end.

It will be appreciated that instead of, or together with, symbols of different configurations, there could also be used different colors.

Many other variations, modifications and applications of the invention will be apparent.

We claim:

1. A puzzle-type game, comprising:

a plurality of at least five manipulatable members, each having a plurality of different regions around the outer face thereof;

each of said manipulatable members being formed at one end with a plurality of fingers defining a circle, and at the opposite end with a circular recess dimensioned to detachably and rotatably receive the fingers of another like manipulatable member, enabling a plurality of said members to be assembled by the player, according to any desired sequence, and to be rotated while so assembled to any desired angular position with repsect to each other;

each of said manipulatable members carrying on the different regions of its outer face indicia representing one element of a valid multi-element relationship produced only when the indicia of all the manipulatable members are aligned according to a predetermined sequence and a predetermined angular position with respect to each other;

each of said manipulatable members being of hollow construction and formed with a central opening therethrough; said plurality of fingers circumscribing said opening in one end of its manipulatable member; said circular recess being formed on the inner face at the opposite end of its manipulatable member for detachably receiving the fingers of another like manipulatable member;

the two ends of each manipulatable member being formed with complementary retainer means to releasably retain attached manipulatable members in each of their rotated angular position; said plurality of fingers being configured such that when received in the circular recess in the inner face of another like manipulatable member, they urge the two so-attached manipulatable members axially towards each other; said complementary retainer means comprising axially-projecting projections formed in one end of each manipulatable member and complementary detents formed in the opposite end.

2. The game according to claim 1, wherein said manipulatable members each define "n" different regions around the outer face thereof, the different regions of some of said manipulatable members carrying indicia representing the numbers 1—n, repsectively, in different sequences, the different regions of others of said manipulatable members carrying indicia representing various arithmetical operations, the valid multi-element relationship between a correct solution to an arithmetic equation represented by the indicia on all the aligned regions of all the attached manipulatable members.

3. The game according to claim 2, wherein each of said manipulatable members has four different regions around its periphery, said number-representing indicia representing the numbers 1, 2, 3 and 4, in different sequences.

4. The game according to claim 1, wherein the different regions of the outer face of one of said manipulatable member carrying indicia representing a plurality of different starting points, and the different regions of the outer faces of the remaining manipulatable members carrying indicia in the form of different arrangements of symbols selectively alignable with the symbols of adjacent manipulatable members, the valid multi-element relationship representing at least one continuous path of like symbols starting from at least one of the starting points of said one manipulatable member.

5. The game according to claim 1, wherein the different regions on the outer faces of at least some of said manipulatable member carry indicia representing alphabetical characters, the valid multi-element relationship representing the correct spelling of one or more words.

6. The game according to claim 1, wherein each of said manipulatable members is of polygonal cross-section.

7. The game according to claim 1, wherein each of said manipulatable members is of circular cross-section.

8. The game according to claim 1, wherein there are nine of said manipulatable members.

* * * * *

UNITED STATES PATENT AND TRADEMARK OFFICE

CERTIFICATE OF CORRECTION

PATENT NO. : 4,651,992

DATED : March 24, 1987

INVENTOR(S) : David Danino and Shachar Ben-Meir

It is certified that error appears in the above-identified patent and that said Letters Patent is hereby corrected as shown below:

Column 3, line 22, change "arithmetical solution" to --arithmetical equation--

Column 6, line 6, change "relationship between" to --relationship being--.

Signed and Sealed this

Ninth Day of February, 1988

*Attest:*

DONALD J. QUIGG

*Attesting Officer*

*Commissioner of Patents and Trademarks*